United States Patent [19]

Pfeifer et al.

[11] 3,972,609

[45] Aug. 3, 1976

[54] ELECTROSTATIC COPYING MACHINE

[75] Inventors: Josef Pfeifer, Unterhaching; Günther Schnall, Eching; Rudolf Eppe, Taufkirchen, all of Germany

[73] Assignee: AGFA-Gevaert, A.G., Leverkusen, Germany

[22] Filed: May 1, 1975

[21] Appl. No.: 573,528

[30] Foreign Application Priority Data

May 4, 1974 Germany ..... 2421661

[52] U.S. Cl. ..... 355/4; 118/637; 355/8; 355/16

[51] Int. Cl.[2] ..... G03G 15/01

[58] Field of Search ..... 355/3 R, 4, 8, 16; 118/637

[56] References Cited

UNITED STATES PATENTS

| | | | |
|---|---|---|---|
| 3,677,633 | 7/1972 | Huber | 355/8 X |
| 3,765,757 | 10/1973 | Weigl | 355/3 R |
| 3,776,629 | 12/1973 | Ogawa | 355/8 |
| 3,848,989 | 11/1974 | Yamaji et al. | 355/4 |
| 3,879,122 | 4/1975 | Wick et al. | 355/4 |

*Primary Examiner*—R. L. Moses
*Attorney, Agent, or Firm*—Michael J. Striker

[57] ABSTRACT

An electrostatic copying machine wherein a carriage is reciprocable between a horizontal copyboard for originals and the flat upper reach of an endless backing belt the outer side of which has a photosensitive surface. The carriage supports at least one exposing device which exposes line images of the original onto the upper side of the upper reach of the belt while the carriage moves from a starting position and the belt is at a standstill. The carriage further supports a corotron which is mounted ahead of the exposing device and charges successive increments of the upper reach, and a developing device which applies toner particles to the electrostatic image on the upper reach. The belt is thereupon moved to transfer the thus obtained powder image onto a paper sheet. The exposing device has several strip-shaped optical imaging components, and the developing device employs a rotary magnetic drum or a set of magnets which are fixedly mounted on the carriage. If the carriage supports several corotrons, several exposing devices and several developing devices, each exposing device contains a differently colored filter so that the powder image is a color image of the original on the copyboard.

14 Claims, 3 Drawing Figures

ELECTROSTATIC COPYING MACHINE

BACKGROUND OF THE INVENTION

The present invention relates to electrostatic copying machines in general, and more particularly to improvements in copying machines of the type wherein a moving exposing device projects an electrostatic image of an original onto a flat photosensitive surface while the surface is at a standstill. Still more particularly, the invention relates to improvements in electrostatic copying machines of the type wherein the exposing device projects a series of line images of an original onto a photosensitive surface which is provided on a mobile backing member.

It is known to employ in an electrostatic copying machine an exposing device which comprises several strip-shaped optical imaging components each of which includes a plurality of lens elements. Such lens elements are used to expose line images of the original while the carriage for the exposing device moves with respect to the original and also with respect to the photosensitive surface on the backing member. Each line image consists of several image portions which are at least contiguous to but may partially overlap each other. It is also known to mount on the carriage one or more light sources (e.g., fluorescent tubes) which illuminate the original while the carriage moves relative to the support for the original and relative to the photosensitive surface. In such machines, the developing device which converts the electrostatic image into a powder image occupies a relatively large amount of space and the carriage must move along a relatively long path. This contributes to the bulk of the copying machine.

SUMMARY OF THE INVENTION

An object of the invention is to provide a simple, compact and inexpensive electrostatic copying machine which can be designed for the making of black-and-white or color copies of originals.

Another object of the invention is to provide a copying machine wherein the space requirements of one or more developing devices for electrostatic images are a small fraction of the space requirements of developing means in conventional electrostatic copying machines.

A further object of the invention is to provide a novel and improved developing device for electrostatic images in an electrostatic copying machine of the type wherein the exposing device moves with respect to the original and with respect to the photosensitive surface during imaging of the original onto such surface.

An additional object of the invention is to provide a novel and improved electrostatic copying machine for the making of color reproductions of originals.

Still another object of the invention is to provide an electrostatic copying machine with novel and improved means for supplying and metering toner particles in one or more developing devices.

A further object of the invention is to provide an improved electrostatic copying machine wherein one or more developing devices can move with the exposing device or devices.

The invention is embodied in an electrostatic copying machine which comprises a support (e.g., a transparent horizontal copyboard) for originals to be copied, a mobile conductive backing member (e.g., an endless belt) having an external photosensitive surface and including a substantially flat portion (e.g., a flat horizontal upper reach if the backing member is a belt) spaced apart from and facing an original on the support, a carriage movable lengthwise of the flat portion of the backing member intermediate the support and the backing member, means for moving the carriage, at least one exposing device mounted on the carriage and having a plurality of preferably strip-shaped optical imaging components each including a plurality of lens elements, at least one light source mounted on the carriage to illuminate the original on the support so that the lens elements project onto the photosensitive surface of the flat portion of the backing member an electrostatic image of the original on the support while the carriage is being moved in a predetermined direction and the electrostatic image consists of successive line images each of which is composed of a plurality of at least contiguous (i.e., contiguous or partially overlapping) image portions, a corona device mounted on the carriage ahead of the exposing device (as considered in the aforementioned direction) for charging successive increments of the flat portion of the backing member, and a developing device mounted at least in part on the carriage behind the exposing device (again, as considered in the aforementioned direction) and having means for converting the electrostatic image on the flat portion of the backing member into a powder image. The backing member is idle during movement of the carriage in the aforementioned direction, and is thereupon moved to transfer the powder image onto a sheet of paper or the like.

The imaging components of the exposing device may include a first strip which is nearest to the support for originals and whose lens elements constitute objective lenses, and a second strip which is nearest to the flat portion of the backing member and whose lens elements constitute imaging lenses. A third imaging component may be installed between the first and second components, and the lens elements of such third component then constitute field lenses.

The novel features which are considered as characteristic of the invention are set forth in particular in the appended claims. The improved copying machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
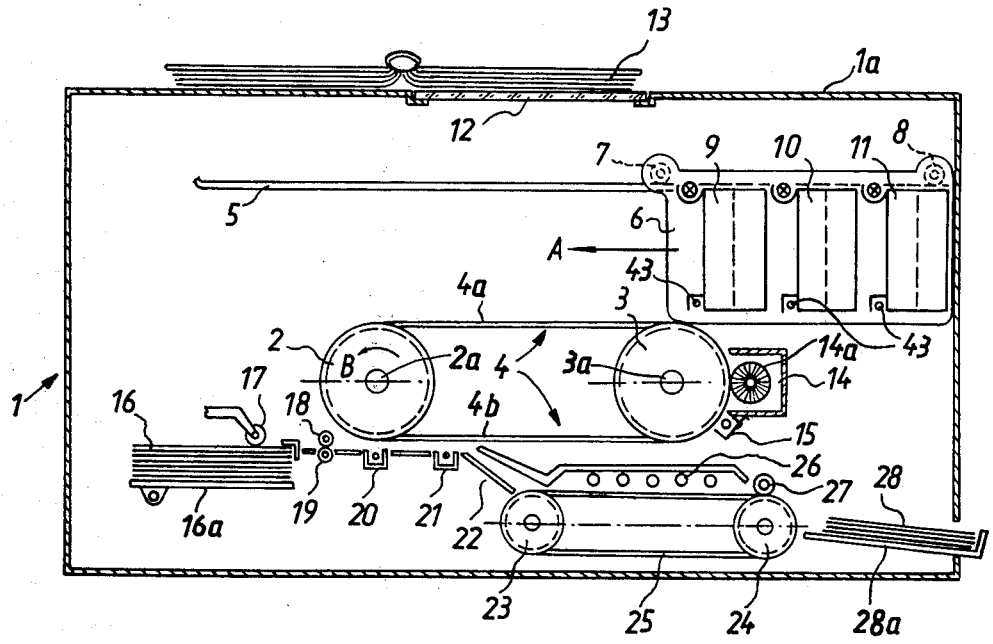
FIG. 1 is a schematic vertical sectional view of an electrostatic copying machine which embodies one form of the invention.

FIG. 1 shows an electrostatic copying machine having a housing 1 including a top wall 1*a* with a light-transmitting support or copyboard 12 for an original 13 (e.g., a book) which is placed onto the copyboard face down. The housing 1 supports the shafts 2*a*, 3*a* for pulleys or drums 2,3 around which is trained an endless flexible conveyor 4 constituting a backing member for a photoconductive surface at the outer side thereof. The flat upper reach 4*a* of the conveyor or backing member 4 (hereinafter called belt for short) is located below and is spaced apart from and parallel to the copyboard 12.

The housing 1 further contains one or more elongated guides 5 (e.g., rails or tie rods) for the roller followers 7 and 8 of a carriage 6 which is reciprocable in and counter to the direction indicated by arrow A. The carriage 6 is located in the space between the upper reach 4*a* of the belt 4 (this upper reach travels intermittently in the direction indicated by arrow B) and the underside of the copyboard 12. The path along which the carriage 6 is reciprocable is parallel to the reach 4*a*. The carriage 6 supports three discrete exposing devices and three discrete developing devices. Each developing device constitutes with the associated exposing device a powder image forming unit, and the three powder image forming units are shown in FIG. 1 at 9, 10 and 11. The units 9–11 can provide the photosensitive surface on the belt 4 with a powder image of an original 13 in response to travel of the carriage 6 in the direction indicated by arrow A.

A cleaning and discharging assembly is adjacent to that portion of the belt 4 which is trained over the pulley 3. This assembly is of known design and the exact construction thereof forms no part of the invention. In the embodiment of FIG. 1, the cleaning assembly comprises a casing 14 for a brush 14*a* which sweeps remaining toner particles from the photosensitive surface on successive increments of the belt 4, and a cleaning corona discharge device 15 located immediately upstream of the casing 14.

A source 16*a* (e.g., a tray) of stacked paper sheets 16 is mounted in the housing 1 to the left of and at a level below the pulley 2. A reciprocable roller 17 serves to feed successive topmost sheets 16 of the stack into the nip of two advancing rolls 18, 19 which move the sheet lengthwise along the lower reach 4*b* of the belt 4 so that the upper side of the sheet receives a powder image from the photosensitive surface. A corona transfer device 20 of conventional design is located at or close to the locus where successive increments of a sheet 16 move into register with successive increments of the powder image on the lower reach 4*b*. The corona transfer device 20 is followed by a sheet stripping corona 21 which causes the sheets 16 (each of which carries a transferred powder image at its upper side) to enter a duct 22 leading into a fixing device or heat fuser including an endless conveyor band 25 trained over pulleys 23, 24 and a battery of infrared lamps 26. A finished sheet 28 leaves the fixing station between the pulley 24 and a driven removing roller 27 and is deposited on top of a stack of finished sheets in a second tray 28*a*. The sheets 28 of the stack in the tray 28*a* are accessible from without the housing 1.

Figure 2:
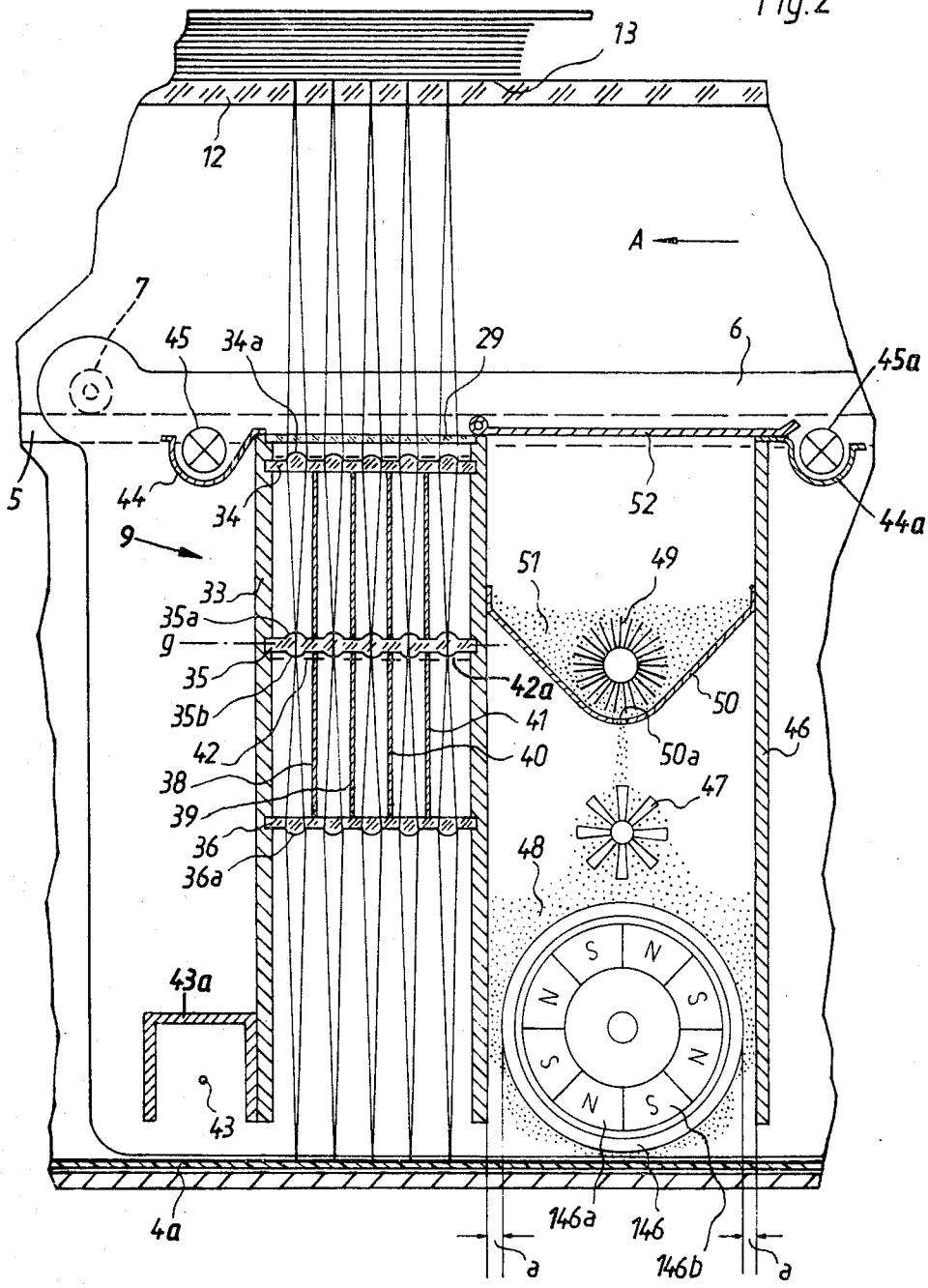
FIG. 2 is an enlarged vertical sectional view of a detail in the copying machine of FIG. 1.

FIG. 2 shows the details of the powder image forming unit 9 which is supported by the left-hand portion of the carriage 6. The exposing device of the unit 9 comprises an upright duct 33 for three strip-shaped optical imaging components including an uppermost strip 34 nearest to the copyboard 12, a median strip 35, and a lowermost strip 36 nearest to the belt 4. The focal length of positive lens elements 34*a* forming part of the uppermost strip 34 is selected in such a way that each thereof projects a line image of the original 13 on the copyboard 12 into a horizontal intermediate image plane *g* which is the central plane of the median strip

35. The latter comprises upper positive lens elements 35*a* and lower positive lens elements 35*b*. The positive lens elements 36*a* of the lowermost strip 36 project the image from the plane *g* onto the photosensitive surface on the upper reach 4*a* of the belt 4 therebelow. The lens elements 35*a*, 35*b* of the median strip 35 constitute field lenses, the lens elements 34*a* are objective lenses, and the lens elements 36*a* are imaging lenses. The lens elements 35*a*, 35*b* perform the function of imaging the exit pupils of the lens elements 34*a* into the entry pupils of the lens elements 36*a*, as, for instance, disclosed in our U.S. Pat. No. 3,592,542 to Käufer et al.

The duct 33 further contains a color filter 29 which is disposed at a level above the uppermost strip 34 and imparts one of three different color hues to the light beams reaching the lens elements 34*a*. The duct (not shown) of the unit 10 contains a differently colored filter, and the duct (not shown) of the unit 11 contains a filter having a third color. The filter 29 is flanked by two light sources 45, 45*a*, one of which is immediately adjacent to the left-hand wall of the duct 33 and the other of which is adjacent to the right-hand wall of the enclosure or duct 46 of the developing device in the unit 9. The light source 45*a* may constitute one of the two light sources in the unit 10. The reference characters 44, 44*a* denote reflectors for the light sources 45, 45*a*.

The duct 33 further contains a horizontal plate 42 having an aperture or stop 42*a* below each positive lens element 35*a*, and vertically extending partitions or shields 38, 39, 40, 41 which extend from the underside of the strip 34 to the upper side of the strip 35 and again from the underside of the strip 35 to the upper side of the strip 36. The partitions 38–41 prevent light rays passing through discrete lens elements 35*a* from straying into the paths of light rays passing through the neighboring lens elements. The partitions 38–41, together with the plate 42, insure that the line images consist of image portions which are least contiguous to but may slightly overlap each other. The belt 4 is at a standstill when the carriage 6 is caused to move in the direction indicated by arrow A, and the belt 4 is thereupon set in motion (arrow B) to transfer the powder image onto one of the sheets 16. A single movement of the carriage 6 in the direction indicated by arrow A suffices to image that portion of the original 13 which is located on the light-transmitting copyboard 12. The lower portion of the left-hand wall of the duct 33 carries a shield 43*a* for a corona discharge device 43 which serves as a means for charging the belt 4. Similar corona discharge devices 43 are mounted on the front walls of ducts 33 in the units 10 and 11 (see FIG. 1).

The duct 46 of the developing device shown in FIG. 2 may but need not be made integral with the duct 33 of the exposing device. The duct 46 is located behind the duct 33, as viewed in the direction indicated by arrow A, and its lower portion contains a magnetic developing drum 146 having a diameter which is slightly less than the width of the duct 46 (again as considered in the direction indicated by arrow A). The axis of the drum 146 is horizontal and is normal to the direction of reciprocatory movement of the carriage 6 and to the direction of intermittent movement of the belt 4. The drum 146 converts exposed images of originals into powder images and is mounted close to or immediately above the open underside of the enclosure or duct 46. The width of gaps or clearances *a* between the periphery of the drum 146 (at the three and nine o'clock positions, as viewed in FIG. 2) and the adjacent walls of the duct 46 is substantially greater than the maximum dimension of a toner particle but substantially less than the maximum distance from which the toner paticles can be attracted to the periphery of the drum 146 by magnetic poles 146*a*, 146*b*. The poles 146*a*, 146*b* alternate with each other and are disposed at the periphery of the drum 146. The aforementioned width of the gaps *a* prevents uncontrolled escape of toner particles from an intermediate supply 48 which accumulates in the duct 46 immediately above the drum 146. Also, such width of the gaps *a* insures that the particles of toner cannot become entrapped in the regions between the drum 146 and the adjacent walls of the duct 46. Such walls are preferably parallel to the optical axes of lens elements in the duct 33.

The duct 46 further accommodates a driven paddle wheel 47 which is disposed above the apex of the drum 146 and below the lowermost portion of a magazine or hopper 50 for a substantial supply 51 of toner particles. The purpose of the paddle wheel 47 is to agitate the intermediate supply 48 of toner particles above the drum 146. The lowermost portion of the magazine 50 has one or more small openings 50*a* disposed below a rotary member here shown as a brush 49 which showers a metered quantity of toner particles from the magazine 50 into the range of orbiting paddles on the hub of the agitating wheel 47. A pivotable or removable closure or cover 52 above the duct 46 can be lifted to allow for admission of a fresh supply of toner particles through the open upper side of the duct 46 and into the magazine 50. The quantity of toner particles which leave the magazine 50 via opening or openings 50*a* depends on rotational speed of the brush 49; such speed can be changed by a variable-speed motor or by a constant-speed motor which drives a variable-speed transmission, not shown. The ports 49, 50 constitute a means for supplying metered quantities of toner particles onto the rotary drum 146.

The operation:

The machine is designed to make color copies 28 of the original 13. The drive (including the shaft 2*a* and/or 3*a* for the belt 4 is idle when the carriage 6 is set in motion (e.g., by a flexible shaft which drives one of the roller followers 7 or 8 in any other suitable way) to advance in the direction indicated by arrow A. The light sources (including the light sources 45, 45*a* shown in FIG. 2) are connected to an energy source. During such movement of the carriage 6, the devices of the units 9, 10 and 11 expose and develop three superimposed electrostatic images of the original 13 onto the photosensitive surface at the outer side of the idle upper reach 4*a*. The manner in which the electrostatic images are exposed and thereupon developed will be readily understood upon perusal of the description of FIG. 2.

In the next step, a separate prime mover (or the prime mover which serves to drive the carriage 6) imparts motion to the shaft 2*a* and/or 3*a*, to the brush 14*a*, to the means for reciprocating the feed roller 17, to one or both advancing rolls 18, 19 and to one or both pulleys 23, 24 and roller 27. The topmost sheet 16 of the stack in the tray 16*a* is advanced at the exact speed of movement of the belt 4. Successive increments of the color powder image on the belt 4 reach the corona transfer device 20 simultaneously with successive increments of the advancing sheet 16. This results in the transfer of powder image onto the upper side of the sheet 16 in a manner well known from the art of electrostatic copying machines. The corona 21 destroys the charge which accumulates at the underside of the advancing sheet (such charge attracted the sheet to the underside of the lower reach 4*b*) whereby the leader of the sheet descends and enters the duct 22 to advance into the fixing device. The band 25 of the fixing device advances the sheet below the infrared lamps 26 to stabilize the image on the sheet and to thus convert the latter into a copy 28 which is transferred (by roller 27) onto the topmost finished sheet or copy in the tray 28*a*. The lamps 26 melt the toner particles and cause penetration of molten coloring matter into the tissue of the sheet which is being transported by the band 25.

An important advantage of the electrostatic copying machine shown in FIGS. 1 and 2 is that it can employ a short carriage 6 (as considered in the direction indicated by arrow A). The length of this carriage can be reduced due to the fact that the constituents of the developing device in each of the units 9, 10 and 11 are disposed one above the other so that the width of the enclosure or duct 46 (again, as considered in the direction indicated by arrow A) need not appreciably exceed the diameter of the rotary magnetic drum 146.

Another important advantage of the copying machine is that it can make several electrostatic images which are accurately superimposed upon each other, i.e., which are in exact register with each other so that the image on each sheet 16 is a highly satisfactory color reproduction of the respective original.

Figure 3:
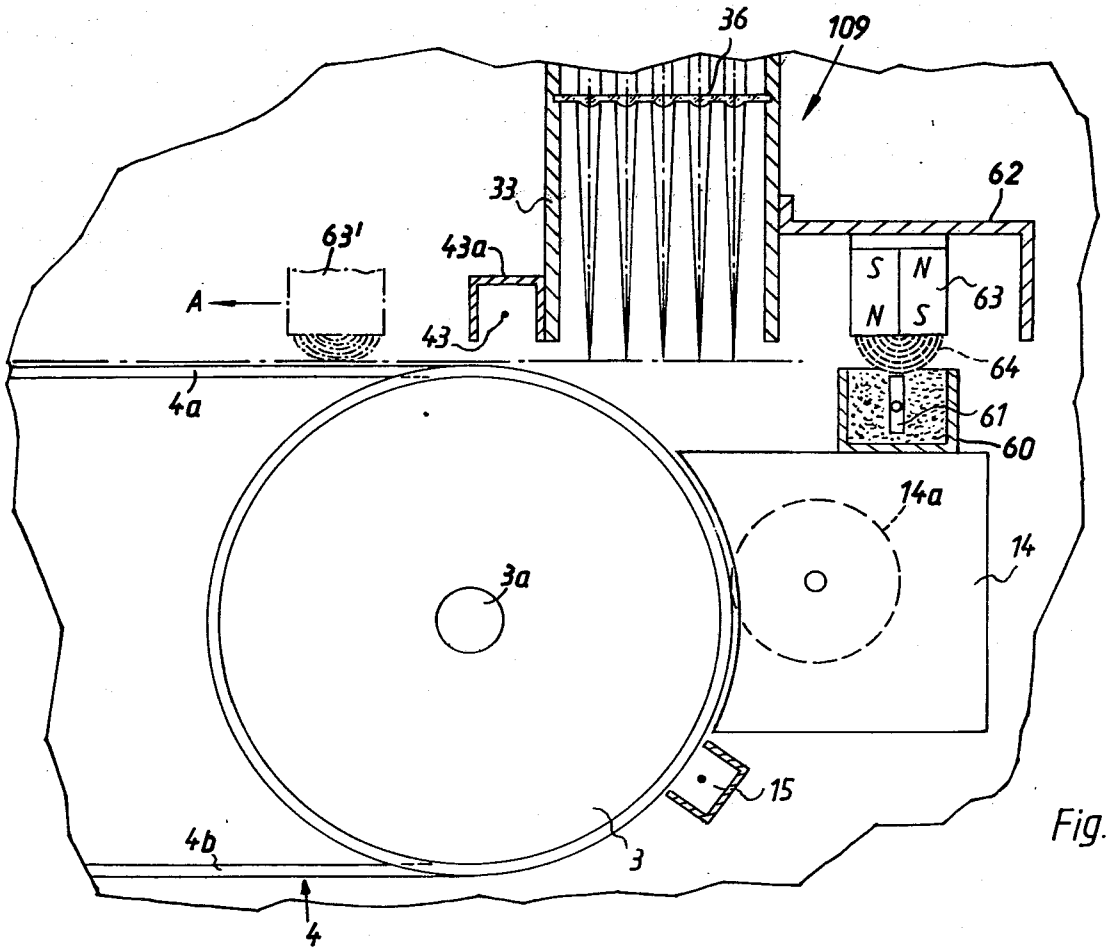
FIG. 3 is a fragmentary schematic vertical sectional view of a second copying machine.

FIG. 3 shows a portion of a simplified copying machine with a single powder image forming unit 109. This unit has an exposing device (including the parts numbered 33, 36) which may be identical with the exposing device of FIG. 2 except that it need not be provided with a filter above the uppermost optical imaging component or strip of lens elements. The rear wall of the duct 33 (as considered in the direction indicated by arrow A) supports a bracket or holder 62 for a system of permanent magnets 63 constituting a means for converting images exposed onto the photosensitive surface at the upper side of the reach 4*a* into powder images. When the carriage for the duct 33 assumes its starting or right-hand end position (as viewed in FIG. 3) the magnets 63 are located above the open top of a magazine or receptacle 60 which constitutes a stationary source of toner particles and contains a rotary or otherwise movable agitating element 61. In the embodiment of FIG. 3, the magazine 60 is mounted directly on the casing 14 for the cleaning brush 14*a* which sweeps toner particles from the photosensitive surface of the belt 4.

When the carriage assumes the starting position so that the magnets 63 are disposed above the open top of the magazine 60, they attract a pile 64 of toner particles. When the carriage is thereupon set in motion so that the unit 109 forms a powder image on the photosensitive surface at the upper side of the upper reach 4*a* of the belt 4, the converting means 63 of the developing device 60, 61, 62, 63 of the unit 109 develops the image which is formed on the photosensitive layer by the lens elements in the duct 33. An intermediate position of the magnets 63 (during movement of the duct 33 in the direction indicated by arrow A) is shown by phantom lines, as at 63'.

The agitating element 61 promotes the accumulation of toner particles on the magnets 63 when the carriage for the duct 33 dwells in the starting position.

The manner in which the powder image formed by the unit 109 is transferred onto a paper sheet and is thereupon fixed to convert the sheet into a finished copy is preferably the same as described in connection with FIG. 1.

The copying machine which embodies the structure of FIG. 3 exhibits the advantage that it employs a surprisingly simple and compact developing device. This developing device need not have any moving parts on the carriage (the magnets 63 are fixed to the bracket 62 of the carriage), and the magazine 60 has an open top so that it can be readily refilled with fresh toner particles, whenever necessary. The agitating element 61 constitutes an optional but desirable component of the developing device. The length of the magnets 63, as considered in the direction indicated by arrow A, can be even less than the diameter of the drum 146 shown in FIG. 2.

If the machine embodying the structure shown in FIG. 3 is to be used for the making of color copies, the foremost unit or units on the carriage may be constructed in a manner as shown in FIG. 2 and the last unit may include a developing device similar to or identical with that shown in FIG. 3.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. In an electrostatic copying machine, a combination comprising a support for originals to be copied; a mobile conductive backing member having an external photosensitive surface and including a substantially flat portion spaced apart from and facing an original on said support; a carriage movable lengthwise of said flat portion intermediate said backing member and said support; means for moving said carriage; at least one exposing device mounted on said carriage and having a plurality of optical imaging components each including a plurality of lens elements and at least one light source for illuminating the original on said support so that said lens elements project onto the photosensitive surface of said portion of said backing member an image of the original on said support while said carriage is being moved in a predetermined direction, said image consisting of successive line images each composed of a plurality of at least contiguous image portions; a corona device mounted on said carriage ahead of said exposing device, as considered in said direction, for charging successive increments of said portion of said backing member; and a developing device mounted on said carraige behind said exposing device, as considered in said direction, and having means for converting said image on said portion of said backing member into a powder image, said backing member being idle during movement of said carriage in said direction.

2. A combination as defined in claim 1, wherein each of said imaging components is a strip and said imaging components include a first strip nearest to said support and having lens elements constituting objective lenses and a second strip nearest to said portion of said backing member and having lens elements which constitute imaging lenses.

3. A combination as defined in claim 1, wherein the photosensitive surface on said portion of said backing member faces upwardly and said developing device further comprises an enclosure having an open underside facing said portion of said backing member, said converting means comprising a rotary magnetic drum mounted in said enclosure above said underside and means for supplying toner particles onto said drum whereby the periphery of said drum attracts such particles and transfers the particles onto the image on said portion of said backing member while said drum rotates and said carriage moves in said direction, said enclosure having wall means defining with the periphery of said drum at least one clearance having a width exceeding the maximum dimension of a toner particle but less than the distance from which said drum can attract toner particles to said periphery thereof.

4. A combination as defined in claim 3, wherein said wall means is at least substantially parallel to the optical axes of said lens elements and said drum is rotatable about an axis which is substantially parallel to said wall means and substantially normal to said direction.

5. A combination as defined in claim 3, wherein said enclosure has an open upper side and said developing device has a cover for said upper side, said cover being movable to a position in which said toner supplying means can receive a fresh quantity of toner particles through said upper side of said enclosure.

6. A combination as defined in claim 3, wherein said toner supplying means comprises means for showering metered quantities of toner particles onto said drum.

7. A combination as defined in claim 6, wherein said metering means comprises a magazine for toner particles, said magazine having a bottom wall with at least one opening therein, and a rotary member mounted in said magazine above said opening to effect the movement of toner particles from said magazine via said opening and onto said drum.

8. A combination as defined in claim 7, wherein said rotary member in said magazine is a brush.

9. A combination as defined in claim 3, further comprising means for agitating toner particles intermediate said drum and said toner supplying means.

10. A combination as defined in claim 1 for making color copies of originals, further comprising at least one additional exposing device mounted on said carriage behind said developing device, as considered in said direction, an additional developing device mounted on said carriage behind said additional exposing device, and a color filter provided in at least one of said exposing devices and being interposed between said support and said portion of said backing member in line with the imaging components of said one exposing device.

11. A combination as defined in claim 10, further comprising at least one additional light source provided on said carriage to illuminate the original for the optical components of said additional exposing device and an additional corona device mounted on said carriage ahead of said additional exposing device to charge said portion of said backing member during movement of said carriage in said direction.

12. A combination as defined in claim 1, wherein said carriage is movable in said direction from a starting position and said developing device further comprises a stationary source of toner particles, said image converting means comprising magnet means mounted on said carriage behind said exposing device and being adjacent to said last mentioned source in said starting position of said carriage so that said magnet means attracts a pile of toner particles and thereupon applies such particles to the image on said portion of said backing member during movement of said carriage in said direction.

13. A combination as defined in claim 12, wherein the photosensitive surface on said portion of said backing member faces upwardly and said source comprises a magazine having an open top, said magnet means being located above said open top of said magazine in said starting position of said carriage.

14. A combination as defined in claim 12, further comprising means for agitating toner particles in said last mentioned source.

* * * * *